US006494192B1

(12) United States Patent
Capshaw et al.

(10) Patent No.: US 6,494,192 B1
(45) Date of Patent: Dec. 17, 2002

(54) ON-BOARD FUEL VAPOR COLLECTION, CONDENSATION, STORAGE AND DISTRIBUTION SYSTEM FOR A VEHICLE

(75) Inventors: William K. Capshaw, San Antonio, TX (US); John C. Hedrick, San Antonio, TX (US); David W. Naegeli, San Antonio, TX (US); Michael G. Ross, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/879,726

(22) Filed: Jun. 12, 2001

(51) Int. Cl.[7] ..... F02M 1/16
(52) U.S. Cl. ..... 123/576; 123/179.16
(58) Field of Search ..... 123/179.16, 518, 123/575, 576; 220/86.1, 723

(56) References Cited

U.S. PATENT DOCUMENTS 3,581,782 A 6/1971 Onufer ..... 141/59
3,752,355 A 8/1973 Weinsenbach ..... 220/86.1
3,794,000 A * 2/1974 Hodgkinson ..... 123/179.16 X
3,799,125 A * 3/1974 Hutchinson ..... 123/576 X
3,807,377 A * 4/1974 Hirschler, Jr. et al. .. 123/179.16 X
3,919,857 A 11/1975 Nichols et al. ..... 62/272
3,921,412 A 11/1975 Heath et al. ..... 62/48.2

FOREIGN PATENT DOCUMENTS

EP 1002946 * 5/2000 ..... F02M/1/16

* cited by examiner

*Primary Examiner*—Tony M. Argenbright
(74) *Attorney, Agent, or Firm*—Paula D. Morris & Assoc., PC.

(57) ABSTRACT

An on-board fuel vapor recovery system draws vapors from a fuel tank, compresses the vapors, and then cools the compressed vapors to form a condensate liquid fuel which is stored in an auxiliary condensate tank for introduction to an engine for enhanced cold start operation.

10 Claims, 1 Drawing Sheet

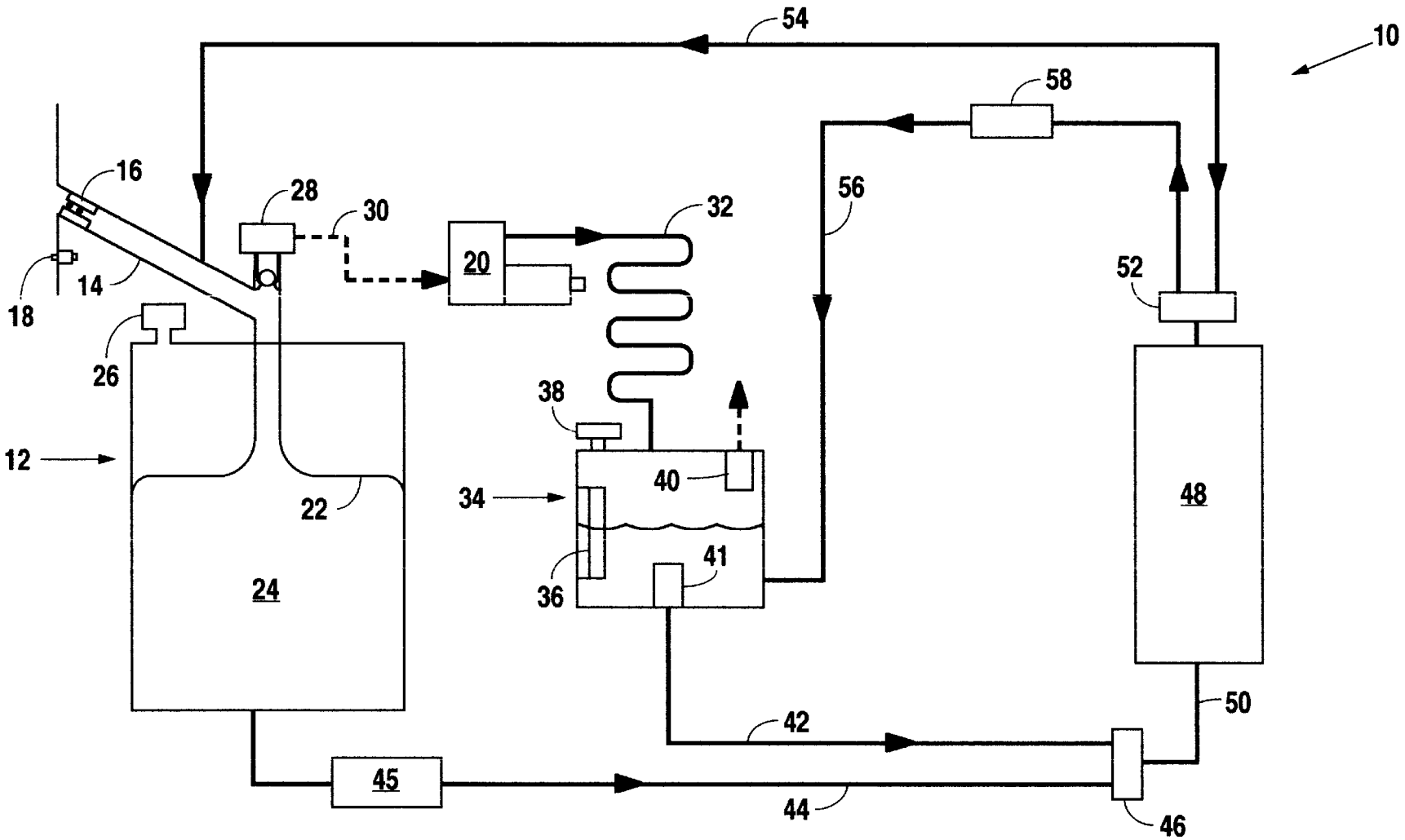
10
48
50
46
52
58
56
54
42
44
32
41
40
38
36
34
20
45
30
22
28
24
16
14
26
18
12

ON-BOARD FUEL VAPOR COLLECTION, CONDENSATION, STORAGE AND DISTRIBUTION SYSTEM FOR A VEHICLE

BACKGROUND OF THE INVENTION

1. Technical Field

This invention relates generally to a system carried on a vehicle for collecting, condensing, storing, and distributing volatile fuel vapors, and more particularly such a system that condenses volatile fuel vapors by compression and cooling to form a liquid fuel stored in a condensate tank for use as a desirable fuel for cold start engine operation.

2. Background Art

Currently, vehicle fuel systems are unable to contain volatile fuel vapors that escape during their refueling process. The vapor space in the tank is displaced by the entering liquid fuel, and fuel vapors are purged out of the fuel pipe to the atmosphere. In addition to vapors lost during refueling, changing ambient conditions allow liquid fuel to vaporize within the tank. These vapors are generally stored in charcoal canisters on the vehicle and are later drawn into the engine intake and consumed during cruise conditions. During hot weather and/or during long engine idle periods, such as in heavy traffic, the charcoal canisters can become saturated and vent fuel vapors to the atmosphere, resulting in excessive evaporate emissions. To contain all of the vapors generated by the worst case scenario, a charcoal canister would have to be prohibitively large.

One attempt to limit the escape of volatile emissions to the atmosphere during refueling is described in U.S. Pat. No. 3,752,355 issued Aug. 14, 1973, to Joseph Weissenbach, titled Contained Volatile Liquids Vapor Retention System. The Weissenbach system proposes the use of a flexible bag in a fuel tank to provide a variable air chamber separate from the fuel disposed in the tank. The flexible container is sealed to the body of a breather tube which allows air to enter or be discharged from the bag, and accordingly the volume of the air chamber bag to change as the fluid level rises and falls in the tank.

Other devices proposed to control vapor emission during transfer of fuel from a stationary storage tank to a vehicle are described in U.S. Pat. No. 3,581,782, issued Jun. 1, 1971, to George R. Onufer, titled Vapor Emission Control System; U.S. Pat. No. 3,919,857, issued Nov. 18, 1975, to Richard A. Nichols, et al, entitled Apparatus for Melting Ice in a Gasoline Vapor Recovery System, describing a method and apparatus for melting ice in the bottom of an absorber in a vapor recovery system when transferring fuel between tanks, and U.S. Pat. No. 3,921,412, issued Nov. 25, 1975, to Stephen D. Heath, et al and entitled Vapor Recovery Apparatus Employing Dispensing Nozzle with Condensing Capacity.

None of the above-described systems are appropriate for on-board vapor recovery systems which are expected to be needed to meet ever-increasingly stringent vehicle evaporate emissions standards. It is desirable to have an effective way to control fuel vapors in a closed fuel system which not only limits the vapor space above the liquid fuel, but also condenses any vapors into a liquid fuel which can be stored for later specific use, such as a highly desirable fuel for cold start engine operation. It is also desirable to have a fuel vapor control system in which the volatile fuel vapors are pressurized as they are drawn from the fuel tank and then condensed to a liquid state for storage in an auxiliary condensate tank. It is also desirable to have a fuel delivery system which selectively delivers a supply of the primary fuel to the vehicle engine during normal operation, or provides condensed fuel vapors for cold engine starting conditions.

SUMMARY OF THE INVENTION

In accordance with one aspect of the present invention, an on-board fuel vapor collection, condensation, consideration, storage and distribution system for a vehicle includes a fuel tank containing a source of liquid fuel for normal operation of an engine of the vehicle, and a fuel vapor condensate tank. A vent valve is disposed in fluid communication with the fuel tank and is adapted to release only fuel vapor from the fuel tank. A fuel vapor compressor is disposed in fluid communication with the vent valve and a heat exchanger is disposed in fluid communication with the fuel compressor and the fuel vapor condensate tank. The heat exchanger is adapted to receive condensed fuel vapor from the compressor, condense the compressed field vapor to form a liquid fuel condensate, and deliver the resulting condensate to the condensate tank. The system further includes a fuel supply solenoid valve and a fuel return solenoid valve, both in fluid communication with the engine of the vehicle. A primary fuel supply conduit provides fluid communication between the fuel tank and the fuel supply solenoid and has a first fuel pump operatively disposed in-line with the primary fuel supply conduit. A condensate supply conduit provides fluid communication between the fuel vapor condensate tank and the fuel supply solenoid. A primary fuel return conduit is disposed in fluid communication between the fuel return solenoid valve and the fuel tank, and a condensate return conduit is disposed in fluid communication between the fuel return solenoid valve and the fuel vapor condensate tank. A second fuel pump is operatively interposed in the condensate return conduit.

Other features of the fuel vapor collection, condensation, storage, and distribution system embodying the present invention includes the fuel tank of the system having an internally disposed flexible bladder. The flexible bladder is arranged to receive a supply of liquid fuel from an external source and defines a volumetrically variable chamber within the fuel tank for storing the liquid fuel. The vent valve, in fluid communication with the fuel tank, is in direct fluid communication with the volumetrically variable chamber defined within the bladder. Other features of the fuel vapor collection, condensation, storage and distribution system embodying the present invention include the fuel vapor condensate tank having a sensor arranged for measuring the liquid level of the condensate in the fuel vapor condensate tank, and a sensor for measuring the pressure present in the fuel vapor condensate tank.

In another aspect of the present invention, an on-board fuel vapor collection, condensation, storage and distribution system for a vehicle includes a means for compressing and condensing fuel vapors formed in the fuel tank, a fuel vapor condensate tank adapted to receive condensed fuel vapors from the means for compressing and condensing fuel vapor formed in the tank, a first valve means for controllably directing a flow of fuel from at least one of the fuel tank and condensate tank to the engine, and a second valve means for controllably directing a flow of unused fuel from the engine to one of the fuel tank and condensate tank.

Other features of the on-board vapor system include the means for compressing and condensing fuel vapors formed in the fuel tank having a vent valve in fluid communication with the fuel tank, a fuel vapor compressor in fluid communication with the vent valve, and a heat exchanger in fluid communication with the fuel vapor compressor and the fuel vapor condensate tank. The heat exchanger is adapted to receive condensed fuel vapor from the compressor, condense the compressed fuel to form a liquid condensate, and deliver the resultant condensate to the condensate tank.

Still other features of the on-board fuel vapor system embodying the present invention include the first valve means for controllably directing a flow of fuel from at least one of the fuel tank and the condensate tank to the engine being a fuel supply solenoid valve, a primary fuel supply conduit providing fluid communication between the fuel tank and the fuel supply solenoid valve, and a condensate supply conduit providing fluid communication between the condensate tank and the fuel supply solenoid valve. A first fuel pump is operatively interposed in the primary fuel supply conduit.

Still other features of the on-board fuel vapor system embodying the present invention include the second valve means for controllably directing a flow of unused, or bypassed, fuel from the engine to either the fuel tank or the condensate tank being a fuel return solenoid valve, a primary fuel return conduit providing fluid communication between the fuel return solenoid valve and the fuel tank, and a condensate return conduit providing fluid communication between the fuel return solenoid valve and the fuel vapor condensate tank. A second fuel pump is operatively disposed in condensate return conduit.

Still other features of the on-board fuel vapor collection system embodying the present invention include the fuel condensate tank having a sensor for measuring the liquid level of condensate in the fuel condensate tank and a pressure sensor for measuring pressure in the fuel vapor condensate tank.

BRIEF DESCRIPTION OF THE DRAWING

A more complete understanding of the structure and operation of the present invention may be had by reference to the following detailed description when taken in conjunction with the accompanying drawing, which is a schematic representation of an on-board fuel vapor collection, condensation, storage and distribution system for a vehicle, embodying the present invention,

DETAILED DESCRIPTION OF A PRESENTLY PREFERRED EXEMPLARY EMBODIMENT

In the present embodiment of the present invention, as shown in the accompanying drawing, an on-board fuel vapor collection, condensation, storage and distribution system 10, mounted on a vehicle, includes a fuel tank 12 that has a filler tube 14 providing for the selective addition of fuel to the tank 12. A fuel nozzle seal 16, for example similar to the nozzle described in the above-referenced U.S. Pat. No. 3,752,355, is provided in the entry neck of the filler tube 14 to provide a seal around a fuel nozzle when fuel is being added to the tank 12. Desirably, a fuel door switch 18 is arranged to provide a signal for activation of a compressor 20 when the fuel door is opened to deliver fuel to the tank 12.

The fuel tank 12 has a flexible bladder 22 disposed within the tank that is arranged to receive fuel delivered through the filler tube 14 and provide a volumetrically variable fuel chamber 24 within the tank 12 for storing the liquid fuel. A pressure regulator 26 provides pressure equalization within the tank 12 as fuel is added to the flexible fuel chamber 24. Desirably, pressure is increased to provide a positive pressure, i.e. above atmospheric pressure, when the fuel door is closed and sealed to minimize the vapor space within the bladder 22. A vent valve 28 is disposed at an upper end of the bladder to permit volatile fuel vapors, but not liquid fuel, to be withdrawn from the bladder 22.

In the schematic drawing, conduits provided for the convenience of vapors are indicated in dashed lines, whereas fluid fuel delivery lines are represented by solid lines. A fuel vapor conduit 30 is provided between the vent valve 28 and the compressor 20 for the transfer of fuel vapors from the variable volume chamber 24 when the compressor 20 is activated. The operation of the compressor and other components of the system 10 embodying the present invention are described below in greater detail.

A heat exchanger 32, for example a conventional air-to-liquid heat exchanger, is disposed between the discharge port of the compressor 20 and a condensate tank 34. The heat exchanger 32 receives compressed fuel vapors drawn from the top of the chamber 24, and condenses the compressed vapors to form a condensate which is delivered to the condensate tank 34. Desirably, the condensate tank 34 also includes a liquid level sensor 36, a pressure sensor 38, a vapor-only check valve 40 which serves as a safety valve to prevent over-pressurization of the condensate tank 34, and a liquid-only check valve 41 which permits flow of liquid condensate fuel from the condensate tank 34 to a condensate fuel supply line 42.

A primary fuel supply line 44 extends between the variable volume chamber 24 of the fuel tank 12 and fuel supply solenoid valve 46. The fuel supply solenoid valve 46 provides selective communication between the condensate fuel supply line 42 and the primary fuel supply line 44 with the fuel injectors of an engine 48 of the vehicle. A first fuel pump 45 is disposed in-line with the primary fuel supply line 44. Desirably, the fuel supply solenoid 46 is modulateable between the condensate fuel supply line 42 and the primary fuel supply line 44 to selectively deliver either condensate fuel or primary fuel to the engine 48, or a mixture of primary and condensate fuels, as described below in greater detail. Alternatively, the fuel supply solenoid valve 46 may be a simple on-off, three-way control valve which permits either one of the fuel supply lines 42, 44, to be in sole direct communication with a fuel intake line 50 to the engine 48.

A fuel return solenoid 52 provides for the selective distribution of unused, or bypassed, fuel from the engine 48 back to the volumetrically variable chamber 24 by way of a primary fuel return conduit 54, or to the condensate tank 34 by way of a condensate fuel return conduit 56. The condensate fuel return conduit 56 includes a second fuel pump 58 operatively disposed in the condensate fuel return conduit 56.

In operation, the flexible bladder 22 in the fuel tank 12 desirably limits the amount of vapor space above the stored liquid fuel. The vent valve 28 in fluid communication with the chamber 24, the fuel vapor compressor 20 in fluid communication with the vent valve 28, and the heat exchanger 32 in fluid communication with the fuel vapor compressor 20 and the fuel vapor condensate tank 34, cooperate to provide a means for compressing and condensing fuel vapors formed in the chamber 24 of the fuel tank 12.

With specific reference to the schematic representation of the present invention, the fuel vapor compressor 20, for example a small 12-volt compressor, draws fuel vapors off the chamber 24 through the fuel tank vent 28, and compresses the vapors to a desired pressure, for example to about 60 PSIA (415 kPa). The condensed fuel vapors then pass through the heat exchanger 32, such as a coiled tube air-to-liquid heat exchanger, whereat the compressed vapors are cooled, forming a liquid condensate which is stored in the condensate fuel tank 34 under pressure maintained by the compressor 20.

In gasoline-fueled vehicles, the major portion of the fuel vapors coming off the chamber 24 of the tank 12 are light hydrocarbons, mainly comprising butanes and pentanes, and are readily condensed into liquid form at pressures around 25 to 30 PSIA (175 to 210 kPa). These light hydrocarbons make an ideal fuel for cold engine starting, since they vaporize immediately after leaving the pressurized fuel system. As shown in the schematic, a secondary loop in the fuel system 10 is sourced at the condensate tank 34 and contains the "light" condensate fuel. Control over selection between the main and secondary fuel systems is accomplished by activation of the fuel supply solenoid 46 and the fuel return solenoid 52, which are regulated by a conventional programmable engine electronic control unit (ECU) or a conventional programmable logic controller (PLC). Since the condensate tank 34 is maintained at approximately the same pressure a fuel in the primary fuel supply line 44 by the first fuel pump 45, another high-pressure fuel pump is not needed in the condensate fuel supply line 42 to introduce fuel to the rail 50 and connect fuel injectors disposed in the engine 48. Desirably, the second fuel pump 58 installed in the condensate fuel return conduit 56 is a small differential pressure pump which allows the condensate fuel bypassing a fuel regulator to return to the condensate tank 34.

As described above, electronic control of the system 10 embodying the present invention may be readily managed by a conventional programmable engine ECU, which would be the most cost effective way to implement control strategy for the system. Control components include compressor 20 start and stop the condensate tank 34 pressure sensor 38, the liquid level indicator 36 on the condensate tank 34, the first fuel pump 45 and the second fuel pump 58, the fuel supply solenoid 46, the fuel return solenoid 52, and the vent control valve 28.

Desirably, the switching process between the main fuel system and the condensate fuel system is carried out in a manner which prevents fuel supplied by the primary fuel tank 12 from entering the condensate tank 34. However, any condensate fuel which enters the primary fuel storage chamber 24 will be recovered by the compressor 20 as it vaporizes when it reaches the chamber 24. To minimize cycling of fuel through the compressor 20, and therefore minimize power required by the system 10, the switching of the fuel supply solenoid 46 and fuel return solenoid 52 desirably incorporates logic to delay switching of the fuel return solenoid 52 when the fuel source is changed. The switching delay is easily determinable by measuring the fuel flow rate, a parameter typically measured by the ECU, and summing the fuel delivery to the engine (total injector pulse width times fuel pressure) to determine the required lag time between activation of the fuel supply solenoid 46 and the fuel return solenoid 52. The inclusion of this additional control parameter prevents the contamination of fuel stored in the condensate tank 34 with liquid fuel from the main tank 12, and also limits the amount of condensate fuel bypassed to the main tank 12.

The volume of the condensate tank 34 should be desirably sized according to the main fuel tank volume, engine displacement, and vehicle size. For example, on long highway trips it is conceivable that the volume of fuel condensed could eventually exceed the capacity of an undersized condensate tank 34. The liquid level sensor 36 is desirably used to determine when the condensate tank if full, and the engine ECU then bleeds some of the condensate fuel into the engine fuel supply rail 50 under cruise conditions. Desirably, a safety margin is maintained above the full liquid level, as determined by the liquid level sensor 36, to allow for vapors recovered and condensed during a refueling stop when the condensate tank 34 is almost full. The liquid level indicator 36 can also determine when the condensate tank 34 is empty, in which case the ECU would switch back to the main fuel supply for a conventional cold start. Through condensation into the condensate tank 34, almost all fuel vapors will be stored in liquid form, and a charcoal canister, common on current emission control systems, would not be required.

The pressure sensor 38 on the condensate tank 34 provides a signal to the ECU to maintain condensate tank pressure by switching the compressor 20 on or off. The pressure regulator 26, outside the flexible bladder 22 of the fuel tank 12 is desirably used to maintain the liquid fuel inside the chamber 24 at an optimum pressure, and for such purpose may be provided with an auxiliary source of compressed air. During refueling, the fuel door switch 18 indicates when the fuel door is open and equalizes the pressure in the fuel tank 12, in the air chamber outside the bladder 22, with the surrounding atmosphere to prevent backflow of fuel through the filler tube 14 during refueling. Also during refueling, the filler nozzle seal 16, disposed in the neck of the fuel tank 12 further prevents escape of fuel vapors during refueling. By condensing and recovering the fuel vapors normally lost during refueling, by activation of the compressor 20 during the refueling process, addition fuel is recovered and vehicle fuel economy will be improved.

The condensate fuel will consist of butane, pentane, and 2-metnylbutane (isopentane). The concentration of these constituents changes little with temperature. This provides a fairly constant reference of fuel energy content to determine the optimum air-fuel ratio for these components. Stoichiometric air/fuel ratio with the condensate fuel will be approximately 15.4:1. Unlike conventional liquid gasoline, the condensate fuel will vaporize almost immediately when leaving the injector in the engine, even in cold start situations. This means that the engine can be operated at the stoichiometric air/fuel ratio when cold, eliminating the need to add extra fuel to make up for the lack of vaporization that occurs when liquid fuel contacts cold engine surfaces. Hydrocarbon emissions are therefore greatly reduced, and cold carbon monoxide (CO) formulation will also be lower. Additionally, starting in cold climates will be improved.

Up to 10% of the total liquid fuel (for gasoline, on a volume basis) is composed of butane, pentane and isopentane. This provides a reference for the maximum available quantity of "light ends" of the liquid fuel. The amount of these light ends that actually vaporize is highly dependent on pressure, temperature and other factors such as disassociation through various liquid fuel constituents.

The preferred embodiment of the fuel vapor control system 10, described above and show on the enclosed schematic drawing, is primarily designed for gasoline-fueled applications. Such a system would not be effective for 100% methanol-fueled application, but it could provide benefits for flexible-fuel systems which use a mixture of gasoline and methanol. In such a flexible-fuel system, the vapors condensed from the gasoline would allow for significant starting improvements over a methanol-gasoline mixture in cold weather.

As can be readily seen from the above description and enclosed schematic drawing, the on-board fuel vapor collection, condensation, storage and distribution system embodying the present invention provides a significant reduction in the release of evaporative emissions to the atmosphere during refueling and starting. In particular, the amount of carbon monoxide and hydrocarbons emitted to the atmosphere are significantly reduced. In addition, the system 10 embodying the present invention provides for the on-board recovery of vapors during refueling, increased fuel economy due to utilization of previously lost fuel vapors during refueling and operation, and easier cold weather starting including lower battery draw for starting.

Although the present invention is described in terms of a preferred exemplary embodiment, those skilled in the art will recognize that changes in particular components of the system, such as providing two separate valves to replace the fuel supply solenoid valve 46 and the fuel return solenoid valve 52 or combined in a single four port valve, may be made without departing from the spirit of the invention. Such changes are intended to fall within the scope of the following claims. Other aspects, features, and advantages of the present invention may be obtained from a study of this disclosure and the drawings, along with the appended claims.

What is claimed is:

1. An on-board fuel vapor collection, condensation, storage and distribution system for a vehicle, said system comprising:

a fuel tank for providing a source of liquid fuel to an engine of said vehicle;

a fuel vapor condensate tank;

a vent valve in fluid communication with said fuel tank, said vent valve being adapted to controllably release fuel vapor from said fuel tank;

a fuel vapor compressor in fluid communication with said vent valve;

a heat exchanger in fluid communication with said fuel vapor compressor and said fuel vapor condensate tank, said heat exchanger being adapted to receive condensed fuel vapor from said compressor, condense the compressed fuel to form a liquid condensate, and deliver the resultant condensate to said condensate tank;

a fuel supply solenoid valve in fluid communication with said engine;

a fuel return solenoid valve in fluid communication with said engine;

a primary fuel supply conduit providing fluid communication between said fuel tank and said fuel supply solenoid and having a first fuel pump operatively interposed therein;

a condensate supply conduit providing fluid communication between said fuel vapor condensate tank and said fuel supply solenoid;

a primary fuel return conduit providing fluid communication between said fuel return solenoid valve and said fuel tank; and a condensate return conduit providing fluid communication between said fuel return solenoid valve and said fuel vapor condensate tank and having a second fuel pump operatively interposed therein.

2. An on-board fuel vapor collection, condensation, storage and distribution system for a vehicle, as set forth in claim 1, wherein said fuel tank of the system has a flexible bladder disposed therein adapted to receive a supply of liquid fuel from an external source and provide a volumetrically variable chamber within said fuel tank for storing said liquid fuel, and said vent valve in fluid communication with said fuel tank is in fluid communication with the volumetrically variable chamber.

3. An on-board fuel vapor collection, condensation, storage and distribution system for a vehicle, as set forth in claim 1, wherein said fuel vapor condensate tank of the system has a sensor for measuring the liquid level of condensate in said fuel vapor condensate tank.

4. An on-board fuel vapor collection, condensation, storage and distribution system for a vehicle, as set forth in claim 1, wherein said fuel vapor condensate tank of the system has a sensor for measuring the pressure present in said fuel vapor condensate tank.

5. An on-board fuel vapor collection, condensation, storage and distribution system for a vehicle having an engine and a fuel tank arranged to supply a source of liquid fuel to said engine, said system comprising:

a means for compressing and condensing fuel vapors formed in said fuel tank of the vehicle;

a fuel vapor condensate tank adapted to receive condensed fuel vapors from said means for compressing and condensing fuel vapor formed in said fuel tank;

a first valve means for controllably directing a flow of fuel from at least one of said fuel tank and said condensate tank to said engine; and a second valve means for controllably directing a flow of unused fuel from said engine to one of said fuel tank and said condensate tank.

6. An on-board fuel vapor collection, condensation, storage and distribution system for a vehicle, as set forth in claim 5, wherein said means for compressing and condensing fuel vapors formed in said fuel tank of the vehicle includes a vent valve in fluid communication with said fuel tank of the vehicle includes a vent valve in fluid communication with said fuel tank, a fuel vapor compressor in fluid communication with said vent valve, and a heat exchanger in fluid communication with said fuel vapor compressor and said fuel vapor condensate tank, said heat exchanger being adapted to receive condensed fuel vapor from said compressor, condense the compressed fuel to form a liquid condensate, and deliver the resultant condensate to said condensate tank.

7. An on-board fuel vapor collection, condensation, storage and distribution system for a vehicle, as set forth in claim 5, wherein said first valve means for controllably directing a flow of fuel from at least one of said fuel tank and said condensate tank to said engine includes a fuel supply solenoid valve in fluid communication with said engine, a primary fuel supply conduit providing fluid communication between said fuel tank and said fuel supply solenoid and having a first fuel pump operatively interposed therein, and a condensate supply conduit providing fluid communication between said fuel vapor condensate tank and said fuel supply solenoid.

8. An on-board fuel vapor collection, condensation, storage and distribution system for a vehicle, as set forth in claims 5, wherein said second valve means for controllably directing a flow of unused fuel from said engine to one of said fuel tank and said condensate tank includes a fuel return solenoid valve in fluid communication with said engine, a primary fuel return conduit providing fluid communication between said fuel return solenoid valve and said fuel tank, and a condensate return conduit providing fluid communication between said fuel return solenoid valve and said fuel vapor condensate tank and having a second fuel pump operatively interposed therein.

9. An on-board fuel vapor collection, condensation, storage and distribution system for a vehicle, as set forth in claim 5, wherein said fuel vapor condensate tank has a sensor for measuring the liquid level of the condensate in said fuel vapor condensation tank.

10. An on-board fuel vapor collection, condensation, storage and distribution system for a vehicle, as set forth in claim 5, wherein said fuel vapor condensate tank has a pressure sensor for measuring the internal pressure in said fuel vapor condensate tank.

* * * * *

UNITED STATES PATENT AND TRADEMARK OFFICE

CERTIFICATE OF CORRECTION

PATENT NO. : 6,494,192 B1
DATED : December 17, 2002
INVENTOR(S) : Capshaw et al.

It is certified that error appears in the above-identified patent and that said Letters Patent is hereby corrected as shown below:

Column 6,
Line 46, delete “formulation” and insert -- formation --.

Signed and Sealed this

Sixth Day of May, 2003

JAMES E. ROGAN
*Director of the United States Patent and Trademark Office*